US007076359B2

(12) United States Patent
Lang et al.

(10) Patent No.: US 7,076,359 B2
(45) Date of Patent: Jul. 11, 2006

(54) METHOD FOR PRODUCING AT LEAST ONE CHARACTERISTIC LINE OF AN AIR MASS DETECTING DEVICE FOR AN INTERNAL COMBUSTION ENGINE

(75) Inventors: Tobias Lang, Stuttgart (DE); Uwe Konzelmann, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 351 days.

(21) Appl. No.: 10/771,602

(22) Filed: Feb. 4, 2004

(65) Prior Publication Data

US 2006/0129306 A1 Jun. 15, 2006

(30) Foreign Application Priority Data

Mar. 25, 2003 (DE) ..... 103 13 217

(51) Int. Cl.
*F02D 41/18* (2006.01)

(52) U.S. Cl. ..... 701/102; 73/118.2

(58) Field of Classification Search ..... 701/102, 701/103, 114, 115; 73/118.1, 118.2
See application file for complete search history.

(56) References Cited

U.S. PATENT DOCUMENTS 5,646,344 A * 7/1997 Konzelmann ..... 73/204.18
5,668,313 A * 9/1997 Hecht et al. ..... 73/118.2

FOREIGN PATENT DOCUMENTS

DE 195 38 451 A1 * 11/1996

* cited by examiner

*Primary Examiner*—Hieu T. Vo
(74) *Attorney, Agent, or Firm*—Michael J. Striker

(57) ABSTRACT

In a method for producing at least one characteristic line of an air mass detecting device for an internal combustion engine precise results can be obtained in the case of a pulsating air flow in a suction region of the internal combustion engine by an air mass detecting device, wherein an adjusted dynamic characteristic line is produced by a non-linear optimization process.

14 Claims, 6 Drawing Sheets

METHOD FOR PRODUCING AT LEAST ONE CHARACTERISTIC LINE OF AN AIR MASS DETECTING DEVICE FOR AN INTERNAL COMBUSTION ENGINE

BACKGROUND OF THE INVENTION

The present invention relates to a method for producing at least one characteristic line of an air mass detecting device for an internal combustion engine.

Such methods are known in the art. In this method an air mass detecting device on the one hand and an accurate comparison probe on the other hand are installed in an impeller testing stand which must simulate the flow situation in an aspiration region of an internal combustion engine. The signals of both sensors are extracted. From the output signals of the air mass detecting device and from the mass stream detected by the comparison probe, a characteristic line is formed which takes into consideration the influence of the geometry of the aspiration region of the internal combustion engine and its action on the signal.

In normal operation of internal combustion engine the signal of the air mass detecting device serves, in addition to other criteria, for determination of the loading condition of the internal combustion engine. Conventionally, a hot film air quantity sensor is used as the air mass detecting device, which is identified as "HFM-sensor".

The characteristic line determined by the testing stand research is identified as a "static" characteristic line, since it is produced at static or stationary flow conditions. It is provided in a control device of the internal combustion engine. The problem is however that in many internal combustion engines the airflow in the aspiration region is not stationary, but instead has a pulsed pattern. The correct detection of such a pulsing air flow in real use is difficult for conventional air mass detecting devices in principle, so that a faulty indication is produced which is a function of the frequency and the amplitude of the flow pulsations.

When however the air mass screen determined by the air mass detecting device does not correspond to the actual air mass stream in the combustion chamber of an internal combustion engine, deviations of the emission behavior of the internal combustion engine from an optimal emission behavior can take place.

SUMMARY OF THE INVENTION

Accordingly, it is an object of the present invention to provide a method of the above mentioned type, which provides for the air mass detecting device in condition of pulsating air flow such results which are as precise as possible.

In keeping with these objects and with others which will become apparent hereinafter, one feature of the present invention resides, briefly stated, in a method of the above mentioned type, in which a dynamic characteristic line is produced in a method which includes the following steps:

b) receiving signals of an air mass detecting device, by placing the air mass detecting device on an internal combustion engine testing stand in different operational points of an air mass flow and detecting signals produced by the air mass detecting device, c) converting the signals of the air mass detecting device into air mass flow values by interpolation on an output characteristic line;

d) forming average values of the air mass flow values via integral plurality of a pulsation period for the corresponding operational point;

e) calculating a deviation, which corresponds to the deviation of the average value of the air mass flow from an accurate comparison air mass flow, for the corresponding operational points;

f) calculating the square norm through the matrix of the deviation;

g) producing an adjusted characteristic line in the sense of an optimization with respect to the condition that the square norm is minimal.

h) recalculating the signals of the air mass detecting device into air mass flow values by interpolation of the adjusted characteristic line; and i) iteration by repeating the steps h), d), e), f), g).

The above mentioned objective is also achieved in a method of the above mentioned general type, in which a dynamic characteristic line is produced by a method which includes the following steps:

a) obtaining the signals of the air mass detecting device, by placing the air mass detecting device in different operational points on an internal combustion engine testing stand of an air mass flow, and detecting signals produced by the air mass detecting device;

b) producing a histogram from the signals through at least one complete pulsation period for the corresponding operational points of the internal combustion engine;

c) recalculating equidistant signal values into air mass flow values by interpolation on an output characteristic line;

d) forming weighted average values of the air mass flow by using the histograms, correspondingly for the operational points;

e) calculating a deviation which corresponds to the deviation of the average air mass flow from a comparison air mass flow correspondingly for the operational points;

f) calculating the square norm through the matrix of the deviation;

g) producing an adjusted characteristic line in the sense of optimization with respect to the condition that the square norm is minimal;

h) recalculating the signals of the air mass detecting device into air mass flow values by interpolation of the adjusted characteristic line; and i) iterating by repeating the steps h), c), d), e), f), and g).

The adjusted dynamic characteristic line formed in accordance with the inventive method leads, in particular in condition of significantly pulsating air flow, to higher accuracy in the determination of the actual air mass flow reaching a combustion chamber of an internal combustion engine from the output signal of the air mass detecting device. Finally, with this method the consumption and emission behavior of the internal combustion engine are significantly improved, since the mixture control is possible with a higher precision.

With the adjusted dynamic characteristic line which deviates from conventional static characteristic lines, the dynamic flow behavior in an aspiration region of an internal combustion engine can be considered very well. In addition, corresponding data in a real internal combustion engine testing stand can be obtained in different operational points and stored. For example rotary speed and load, wherein the load can be indicated for example by the torque or the combustion chamber average pressure. With obtaining the data by a suitable selection of the operational points, advantageously the whole operation region of the internal combustion engine can be covered.

The modified characteristic line in addition is independent from the presence of correction characteristic fields in a control device, which processes the output signals of the air mass detecting device, so that the inventive method can be used also with such control devices which do not have such a correction characteristic field.

For forming an average value through the standard deviations in the testing stand, the signal of the air mass detecting device is indicated in the same time window as the signal of the comparison probe. This high time resolution of the measurement must not be worsened, since otherwise the important dynamic effects no longer can be correctly detected. For this reason when the inventive method a great grade quantity of data is developed.

With the use of histograms proposed in the second-mentioned inventive method, a significant reduction of the data quantity with maintaining of the dynamically relevant informations is provided. For the corresponding operational point, instead of the full signal of the air mass detecting device, only a histogram of the signal is supplied. During the characteristic line optimization, it is not necessary to recalculate each individual signal value of the air mass detecting device by interpolation of the characteristic line in an air mass flow, but instead the limits of the equidistant histogram channels (in the practice its unit is volt) are replaced by a Binning-vector (unit for example kg/h) interpolated on the characteristic line. The decisive feature is that only a fixed number of interpolation is required, which is equal to the dimension of the Binning-vector. The number of the interpolations is also independent from the scope of the measuring data, while the measuring accuracy improves with the scope of the measuring data.

With the use of histograms it is possible to reduce the data quantity by several orders. This leads to the situation that the optimization algorithm converges significantly faster. Depending on the characteristic of the aspiration region of the internal combustion engine, with this method a convergence of an optimization process is possible.

In accordance with the first embodiment of the invention it is proposed that the Levenberg-Marquardt method is used for the non-linear optimization. The non-linear optimization method converges relatively fast and is simple to program. Alternatively, genetic algorithms or evolution strategies for optimization can be utilized.

The iteration can be interrupted after a predetermined number of iteration steps. Thereby the calculation expense remains within a predetermined range.

Alternatively, it is also possible to interrupt the iteration at reaching a predetermined value for the square norm. In this case the accuracy of the optimization results is provided.

It is further advantageous when different accidently generated static characteristic lines are used as output characteristic lines. This makes possible the recognition of sub-optimal extrema. The result of the optimization is thereby again improved.

Further it is proposed to perform the optimization also with respect to a secondary condition, through which a desired course of the adjusted characteristic line is taken into consideration. Thereby for example a demand in accordance with a monotonous course of the adjusted characteristic line can be provided in calculations.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
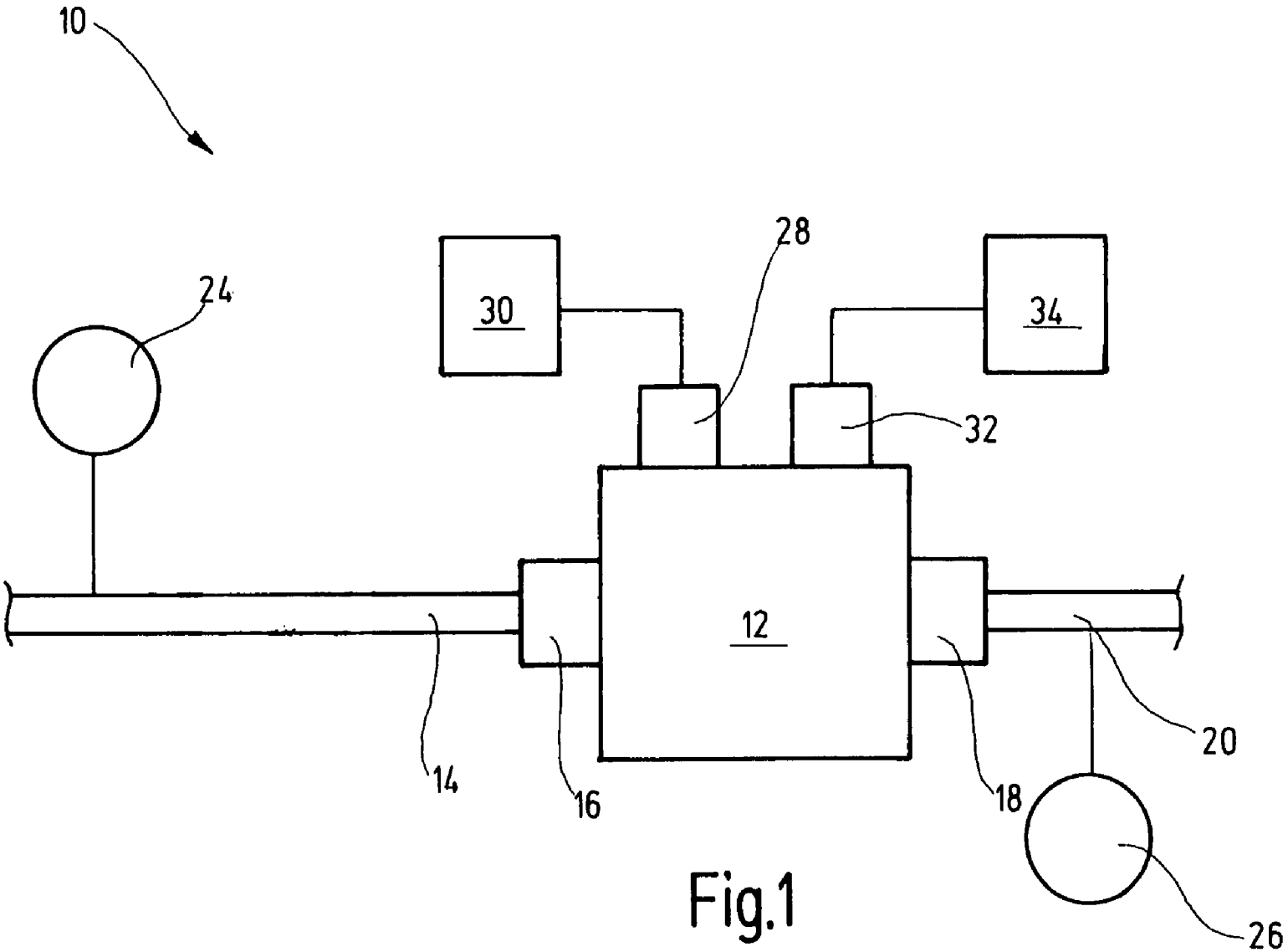
FIG. 1 is a view schematically showing an internal combustion engine with an air mass detecting device.

A diesel internal combustion engine is identified in FIG. 1 as a whole with reference numeral 10. It includes several cylinders, from which only one is shown in FIG. 1 for clarity. It has a combustion chamber 12, into which air is supplied through an aspiration pipe 14 and an inlet valve 16. The combustion gasses escape from the combustion chamber 12 through an outlet valve 18 and an exhaust gas pipe 20. The air mass flow which flows through the aspiration pipe 14 is detected by an air mass detecting device 24, which is formed in this case as an HFM sensor.

The air mass stream is further detected by a high accuracy comparison probe 26, which is formed as a so-called "air clock" arranged in the exhaust gas pipe 20. Fuel is supplied directly to the internal combustion chamber 12 through an injector 28, which is supplied from a high pressure fuel system 30. An incandescent device 32 facilitates firing of the mixture in the combustion chamber 12 in condition of a cold start.

Figure 2:
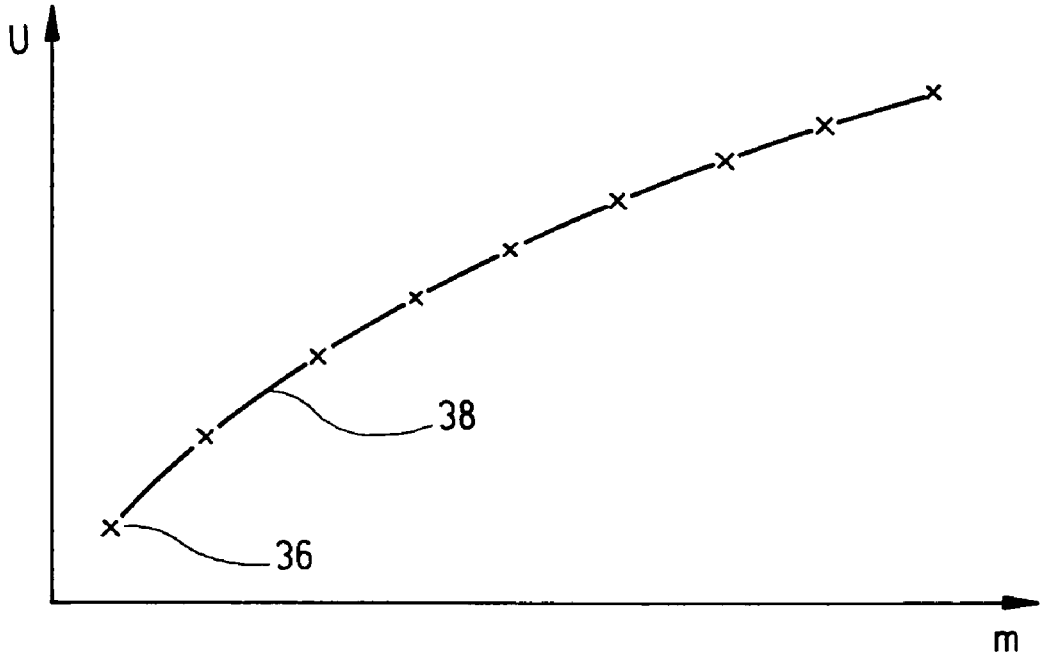
FIG. 2 is a characteristic line of the air mass detecting device of FIG. 1.

The determination of the air mass which is supplied through the aspiration pipe 14 into the internal combustion chamber is very important for the correct mixture control in the combustion chamber 12. It is therefore desired to detect the air mass flow by the HFM sensor 24 with highest possible precision. For this purpose a characteristic line is utilized which links the output signal $U_{HFM}$ of the HFM sensor 24 with a corresponding air mass stream m. An example for such a characteristic line 38 is shown in FIG. 2. It includes a plurality of support points 36. The characteristic line 38 is produced by interpolation between the support points 36. Depending on the construction, more or less strong air pulsations can occur in the aspiration pipe 14.

Figure 3:
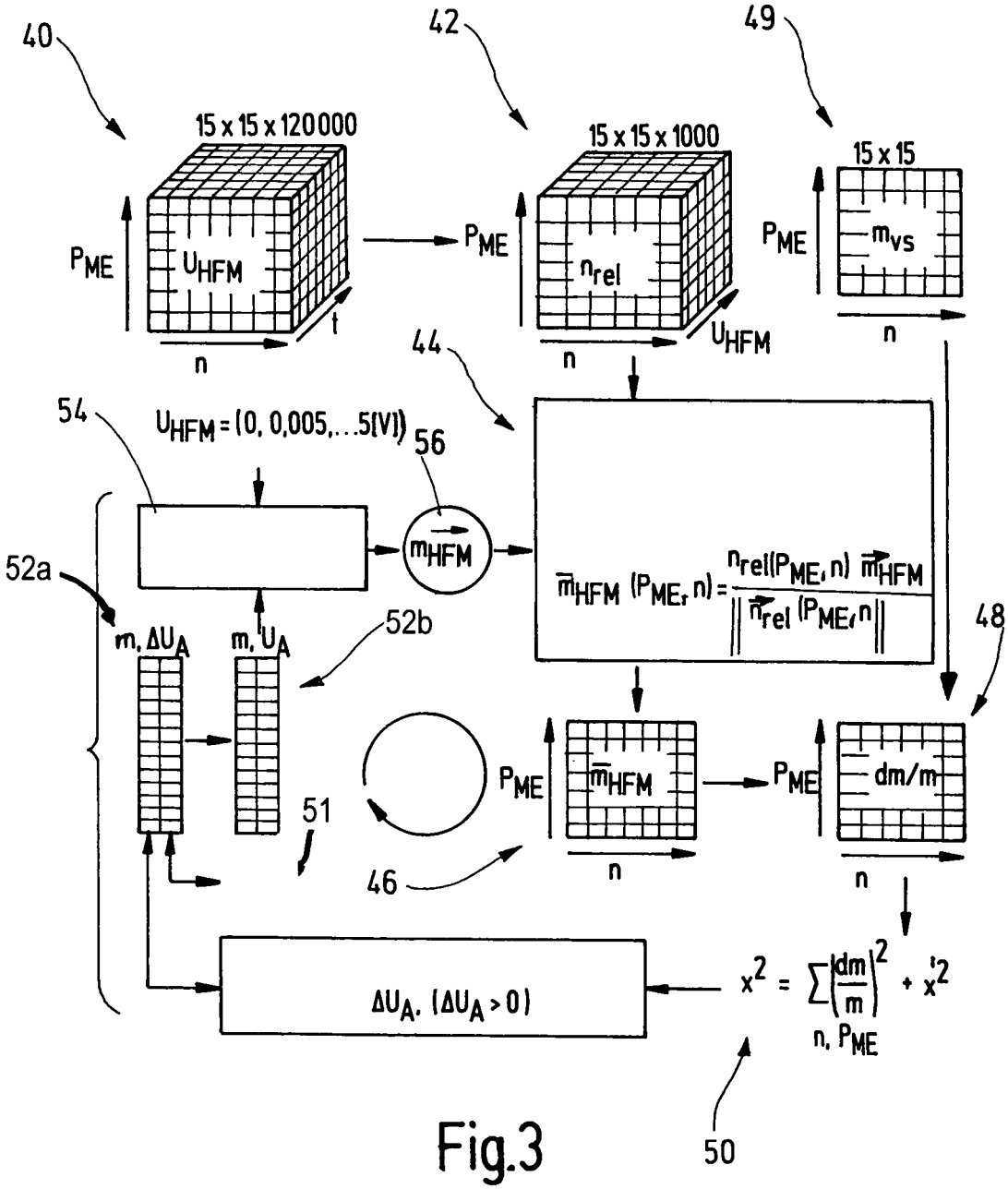
FIG. 3 is a view schematically showing a first embodiment of a method for producing a modified dynamic characteristic line for the air mass detecting device of FIG. 1.

As a result of thermodynamic and aerodynamic effects on the HFM sensor 24, these air pulsations can lead to faulty measuring results, which can not be considered in the conventional use statistic characteristic lines. In order to minimize this error, a modified dynamic characteristic line is produced, which takes into consideration also dynamic flow effects in the aspiration pipe 14 and so exactly represent the air mass flow which flows through the aspiration pipe 14 to the combustion chamber 12. For this purpose a non-linear optimization process is performed, which is illustrated in FIG. 3.

First of all during a testing stand operation with the internal combustion engine 10, the coarse signals of the HFM sensor 24 are indicated at different rotary speed/load points. In the shown example these signals are detected for 15 different rotary speeds and 15 different loads 60 seconds long with a time resolution of 0.5 msec. This produces the output voltage $U_{HFM}$ of the HFM sensor 24 as an array with the dimensions 15×15×120000 (reference numeral 40 in FIG. 3).

Figure 4:
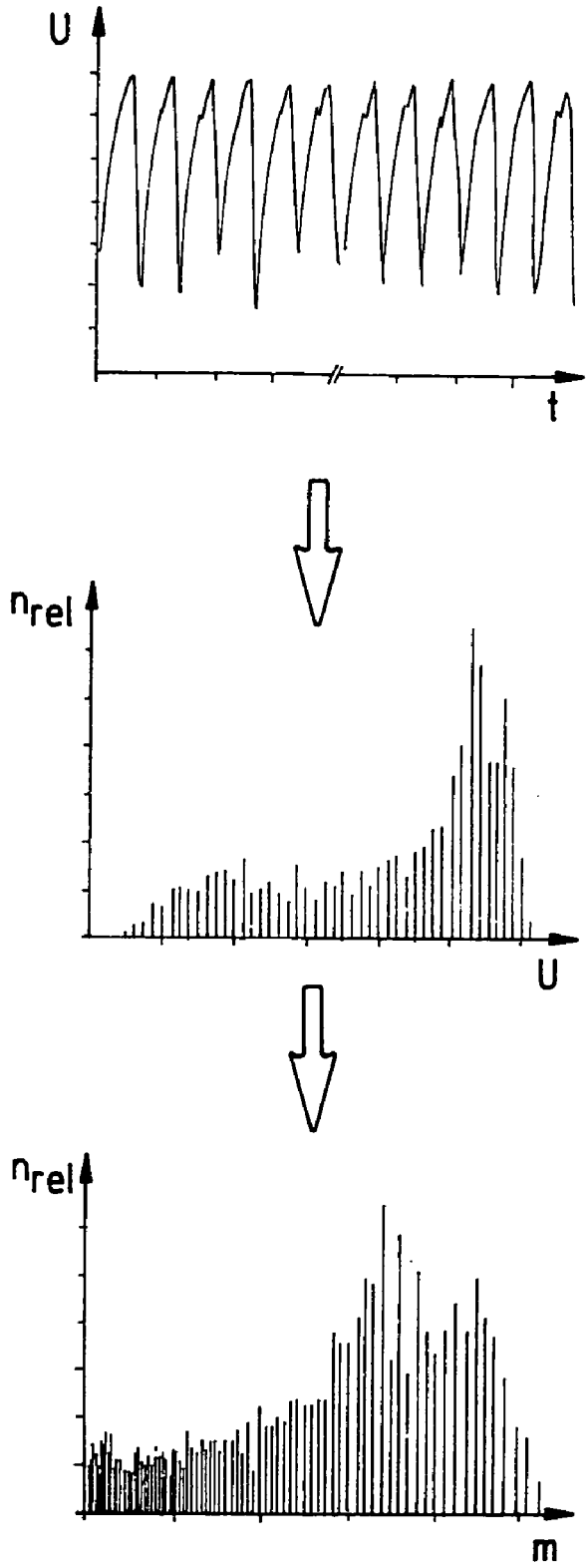
FIG. 4 is a view showing two diagrams which provide data reduction by formation of histograms.

This data quantity is reduced with maintaining the dynamical relevant information by the determination of histograms. For each rotary speed/load point of the indicated time-dependent voltage signal U=f(t)(the uppermost diagram in FIG. 4) for a complete pulsation period in a histogram $n_{rel}$=f(U)(central diagram in FIG. 4). A histogram corresponds on the one hand to an averaging over the whole measuring time t, or in other words over all standard deviations. On the other hand, it contains in it the total relevant dynamic information.

The voltage $U_{HFM}$ is represented in equidistant steps with a fixed step width (a region from zero to 5 volt is covered with a step width of 0.005 volt). The produced array $n_{rel}$ (reference numeral 42 in FIG. 3) has in this example the dimension 15×15×1000. Thereby a reduction of the data quantity by two orders is achieved with approximately 180 MB to only approximately 1.8 MB.

In 54 the voltage values $U_{HFM}$ of 0 to 5 volt (step width 0.005 volt) is interpolated with square interpolation on a characteristic line provided in 52*b*. It has conventionally initially ("initial guess", reference numeral 51) distances $\Delta U_A$ (reference numeral 52*a*) between the supporting points, which correspond to the distances between the supporting points (m, $U_A$) of a conventional static characteristic line. The above presented interpolation means nothing else but not each individual signal value of the HFM sensor 24 is recalculated by interpolation on the characteristic line into an air mass flow, but instead however the limits of the equidistant histogram channels (unit:volt) is replaced by a Binning-vector (unit:kg/h) interpolated on the characteristic line. The result is an air mass flow vector $m_{HFM}$(reference numeral 56).

In 44 for each operational point n, $P_{ME}$ a weighed average value for the air mass flow $m_{HFM}$ is formed. It corresponds to the gravity point of the corresponding histogram. This leads to an air mass flow $\overline{m}_{HFM}$ as a two-dimensional array, depending on the rotary speed n and the load $P_{ME}$ (reference numeral 46). In 48 from it the relative deviation dm/m is calculated which is the difference between the determined air mass flow (block 46) and the air mass flow $m_{VS}$ determined via the comparison probe 26 referred to the air mass flow detected by the comparison probe (the air mass flow $m_{VS}$ is provided depending on the rotary speed n and the load $P_{ME}$ in 49 as a two-dimensional array). It is to be understood that in other embodiments, instead of the values determined by an accurate comparison probe, also the values determined in different ways can be utilized, which correspond the best to the actual air mass flow.

With these matrix of the relative deviation dm/m, the square norm $X^2$ is now calculated in 50. It corresponds to the sum of the square of the deviations over all rotary speed-/load points. The calculation of the square norm $X^2$ is performed by a sums formation over the square matrix components. The optimization target is the minimization of this number, which leads to new distances $\Delta U_A$ (reference numeral 52*a*) between the support points of the characteristic line. Therefore in 52*b* a modified characteristic line is obtained, which is characterized by the corresponding new supporting points m(air mass flow) and $U_A$ (voltage).

Through the term $X'^2$, secondary conditions can be taken into consideration during the optimization. For example a monotonous course can be extended from the characteristic line. Characteristic lines with non-monotonous course can be excluded as optimization result. This can be taken into consideration by a term $X'^2$ which is great with a negative $\Delta U_A$. By means of a square interpolation, this new characteristic line 52 is again recalculated to the equidistant voltages $U_{HFM}$ as new supporting points which serve as Binning-vector and during the formation of the histograms. Thereby new air masses $\overline{m}_{HFM}$ (reference numeral 56) are produced in accordance with the characteristic line in association with the voltages of the Binning vector.

The steps 54, 56, 44, 46, 48, 50, 52*a*, and 52*b* are repeated in the sense of an iteration so often, until either a predetermined number of iteration steps is reached or the square norm $X^2$ reaches a predetermined value. Because of the data reduction by means of histogram, the time period required for the optimization amounts, in the presented example on a conventional calculation device, to approximately only 30 seconds. The time advantage produced by the data reduction is greater with the greater available data quantity.

Figure 5:
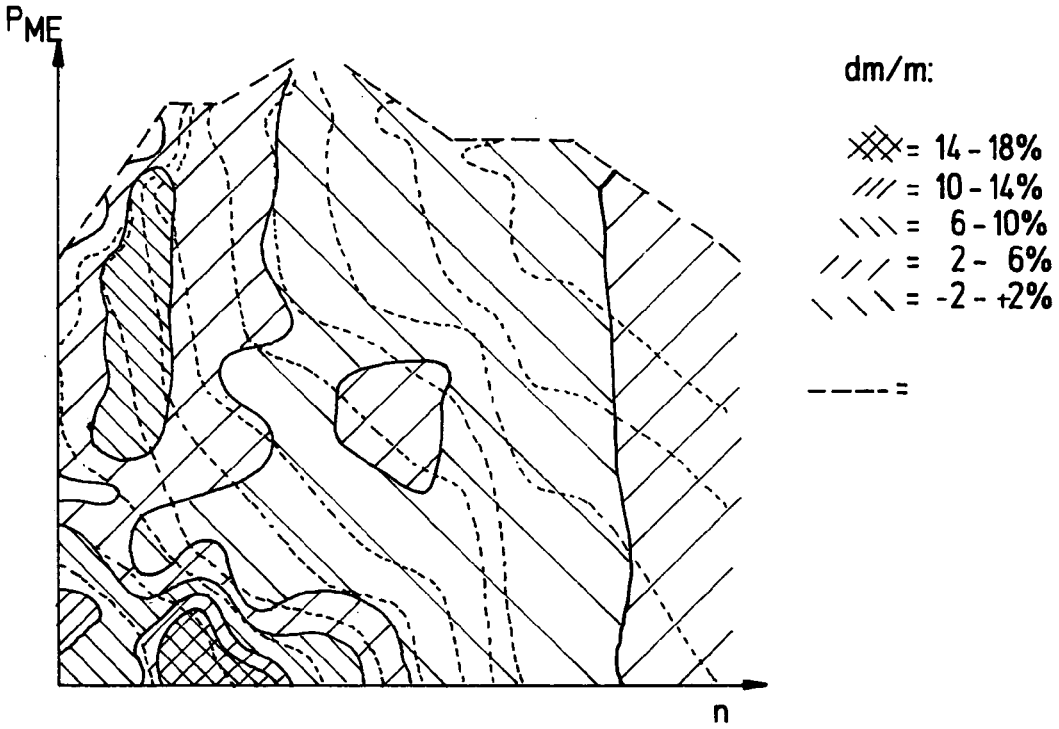
FIG. 5 is a view showing a diagram, in which surfaces with the same relative deviation of the air mass flow determined from the statistic characteristic line from actual air mass flow are plotted at different operational points of the internal combustion engine of FIG. 1.
Figure 6:
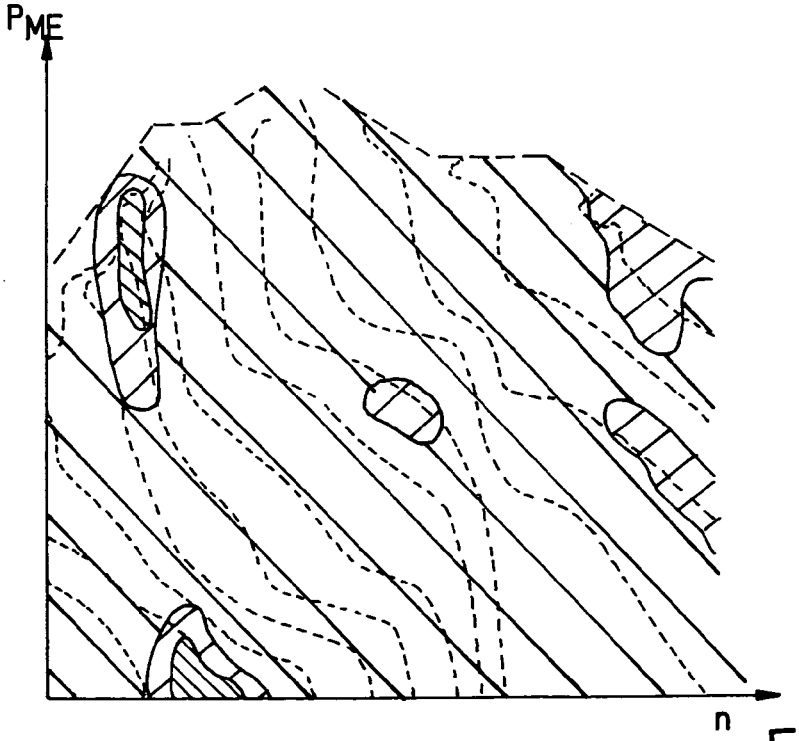
FIG. 6 is a view showing a diagram which is substantially similar to the diagram of FIG. 5 on the basis of the adjusted dynamic characteristic line.

The accuracy of the modified dynamic characteristic line which is finally obtained in 52, when compared with a statistic characteristic line, is clear from a comparison of the diagrams of FIGS. 5 and 6. In them the surfaces are plotted with the same relative deviations dm/m, or in other words, the air mass flow determined by means of the corresponding characteristic line from the actual air mass flow, depending on the rotary speed n and the average pressure $P_{ME}$ corresponding to the load. It can be seen that in the total operational region of the internal combustion engine 10, with the use of the modified dynamic characteristic line, the maximum relative deviation is between 6 and 10%, in wider regions is however only between −2 and +2% (FIG. 6). With the use of a conventional static characteristic line, to the contrary at lower rotary speeds deviations up to 18% are determined (FIG. 5).

Figure 7:
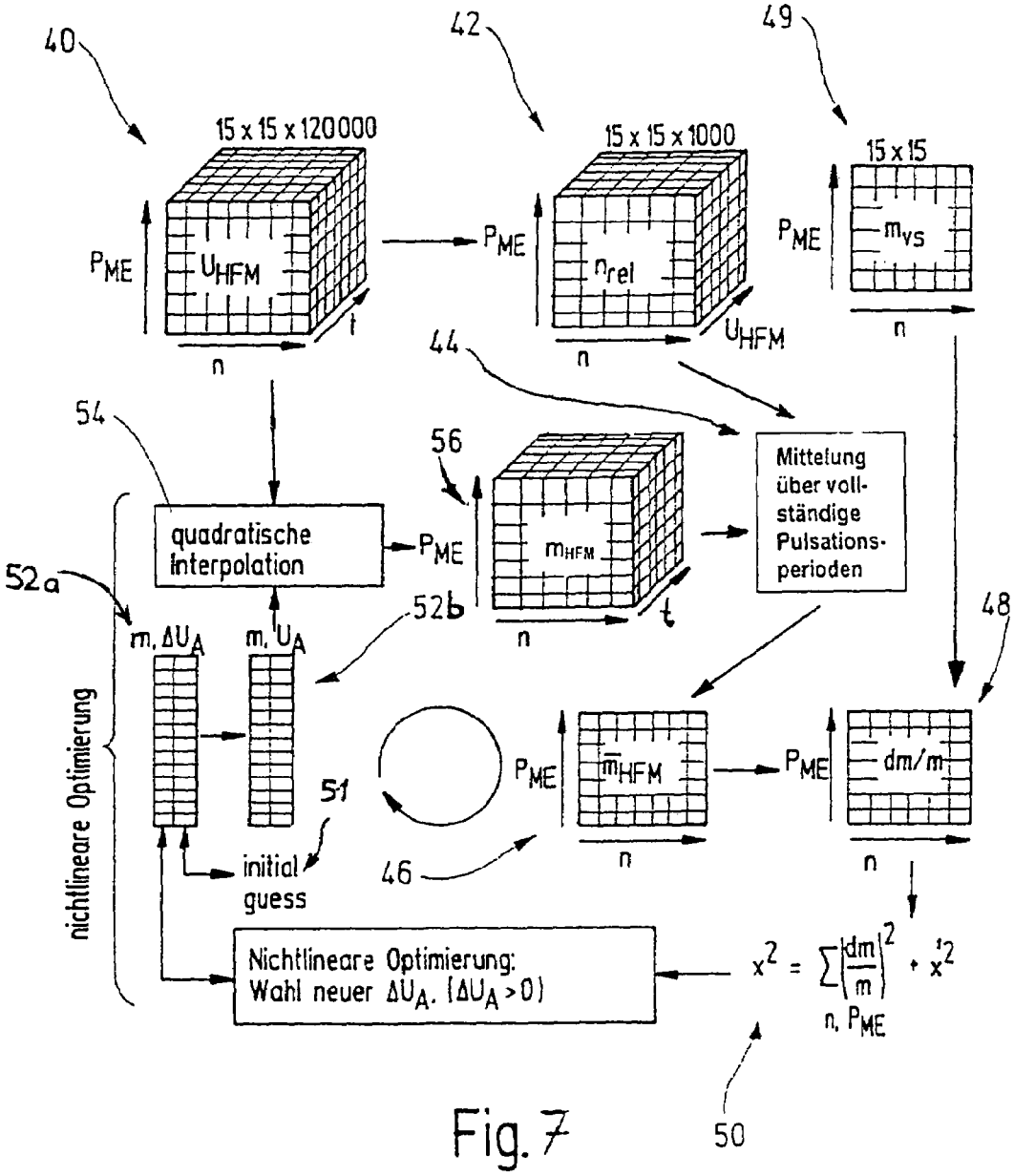
FIG. 7 is a schematic similar to the view of FIG. 3 for a second embodiment of a method for producing an adjusted dynamic characteristic line for the air mass detecting device of FIG. 1.

FIG. 7 shows a flow diagram of an alternative embodiment of the above described method. The same reference numerals as in FIG. 3 are utilized for functionally equivalent regions. The regions described in FIG. 3 are not illustrated in connection with FIG. 7 in detail.

The method shown in FIG. 7 differs from the method shown in FIG. 3 in that a data reduction by formation of histograms is dispensed with. This leads to the situation that in 54 instead of 1,000 interpolations per rotary speed-/load point 27, millions interpolations (15×15×120000) are required. The corresponding calculation time for the optimization is therefore significantly longer than in the method shown in FIG. 3 (approximately 6 weeks on the conventional computing device), and the optimization converges slower.

It will be understood that each of the elements described above, or two or more together, may also find a useful application in other types of methods and constructions differing from the types described above.

While the invention has been illustrated and described as embodied in method for producing at least one characteristic line of an air mass detecting device for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing at least one characteristic line of an air mass detecting device of an internal combustion engine with linking an output signal of the air mass detecting device with an air mass flow, comprising the steps of a) obtaining coarse signals of an error mass detecting device by placing the air mass detecting device at a different operational points of an internal combustion engine testing stand of an air mass flow, and detecting signals produced by the air mass detecting device;

b) recalculating the coarse signals of the air mass detecting device into air mass flow values by interpolation of an output characteristic line;

c) forming average values of the air mass flow values via integral multiple of a pulsation period for a corresponding operational point;

d) calculating a deviation which corresponds to a deviation of the average air mass flow from a comparison air mass flow for a corresponding operational point;

e) calculating a square norm through a matrix of the deviation;

f) producing an adjusted characteristic line in the sense of optimization with respect to a condition that the square norm is minimal;

g) recalculating the course signals of the air mass detecting device into air mass flow values by interpolation on the adjusted characteristic line; and h) iterating by repeating the steps g), c), d), e), and f).

2. A method as defined in claim 1; and further comprising using as optimization a non-linear optimization in accordance with the Levenberg-Marquard method.

3. A method as defined in claim 1; and further comprising interrupting the iterating after a predetermined number of iteration steps.

4. A method as defined in claim 1; and further comprising interrupting the iterating after reaching a predetermined value for the square norm.

5. A method as defined in claim 1; and further comprising detecting the signals in a total region of the internal combustion engine selected from the group consisting of a load region, a rotary speed region, and both, of the internal combustion engine.

6. A method as defined in claim 1; and further comprising using different accidentally generated statistic characteristic lines as output characteristic lines.

7. A method as defined in claim 1; and further comprising performing the optimization also with respect to a secondary condition, with which a desired coarse of the adjusted characteristic line is taken into consideration.

8. A method of producing at least one characteristic line of an air mass detecting device for an internal combustion engine with an output signal of the air mass detecting device linked with an air mass flow, comprising the steps of a) obtaining coarse signals of an air mass detecting device by placing the air mass detecting device at different operational points on an internal combustion engine testing stand of an air mass flow, b) detecting signals produced by the air mass detecting device, c) producing a histograms from the coarse signals through at least one complete polarization period for a corresponding operational point of the internal combustion engine;

d) recalculating equidistant signal values into air mass flow values by interpolation on an output characteristic line;

e) forming weighted average value of the air mass flow values with the use of the histogram, in correspondence for the operational points;

f) calculating a deviation which corresponds to a deviation of the average air mass value from a comparison air mass value;

g) calculating a square norm through a matrix of the deviation;

h) producing an adjusted characteristic line in the sense of an optimization with respect to a condition that the square norm is minimal;

i) recalculating the signals of the air mass detecting device into air mass flow values by interpolation on the adjusted characteristic line; and j) iterating by repeating the steps h), d), e), f), and g).

9. A method as defined in claim 8; and further comprising using as optimization a non-linear optimization in accordance with the Levenberg-Marquard method.

10. A method as defined in claim 8; and further comprising interrupting the iterating after a predetermined number of iteration steps.

11. A method as defined in claim 8; and further comprising interrupting the iteration after reaching a predetermined value for the square norm.

12. A method as defined in claim 8; and further comprising detecting the signals in a total region of the internal combustion engine selected from the group consisting of a load region, a rotary speed region, and both, of the internal combustion engine.

13. A method as defined in claim 8; and further comprising using different accidentally generated statistic characteristic lines as output characteristic lines.

14. A method as defined in claim 8; and further comprising performing the optimization also with respect to a secondary condition, with which a desired coarse of the adjusted characteristic line is taken into consideration.

* * * * *